US007751736B2

(12) United States Patent
Watanabe

(10) Patent No.: US 7,751,736 B2
(45) Date of Patent: Jul. 6, 2010

(54) IMAGE DENSITY CORRECTION METHOD AND IMAGE FORMING APPARATUS USING THE SAME

(75) Inventor: Masaru Watanabe, Chuo-ku (JP)

(73) Assignee: Kyocera Mita Corporation, Osaka (JP)

( * ) Notice: Subject to any disclaimer, the term of this patent is extended or adjusted under 35 U.S.C. 154(b) by 223 days.

(21) Appl. No.: 12/154,263

(22) Filed: May 21, 2008

(65) Prior Publication Data

US 2008/0292340 A1 Nov. 27, 2008

(30) Foreign Application Priority Data

May 23, 2007 (JP) ..... 2007-136186

(51) Int. Cl.
*G03G 15/00* (2006.01)
*G03G 15/06* (2006.01)

(52) U.S. Cl. ..... 399/49; 399/55

(58) Field of Classification Search ..... 399/49, 399/53, 55, 60

See application file for complete search history.

(56) References Cited

U.S. PATENT DOCUMENTS 6,226,466 B1 * 5/2001 Ojima et al. ..... 399/49
6,434,348 B1 * 8/2002 Tomizawa ..... 399/49 X
7,257,336 B2 * 8/2007 Narimatsu et al. ..... 399/49 X
7,412,178 B2 * 8/2008 Karasawa ..... 399/49

FOREIGN PATENT DOCUMENTS

JP 2006-079001 3/2006

* cited by examiner

*Primary Examiner*—Sandra L Brase
(74) *Attorney, Agent, or Firm*—Jordan and Hamburg LLP

(57) ABSTRACT

In an image density correction method in accordance with an embodiment of the present invention, an image density correction is carried out by obtaining an actual toner amount through obtaining a density of a between-sheet patch image having been formed during continuous printing, reconstructing relational characteristics in which the actual toner amount is associated with each variation in developing biases, by considering that the actual toner amount and a reference toner amount are to be made in agreement, when a determination that the actual toner amount disagrees with the reference toner amount is made, and resetting a developing bias for realizing the reference toner amount based on the reconstructed relational characteristics and the reference toner amount. By this means, a high quality image can be obtained by suppressing color fluctuations with printing efficiency maintained at a high level even if large color fluctuations occur during continuous printing.

10 Claims, 7 Drawing Sheets

| Color | Developing bias | Actual toner amount relative to developing bias | Reference toner amount |
|---|---|---|---|
| M | V1 | 0.12 | 0.16 |
| | V2 | 0.14 | |
| | V3 | 0.17 | |
| | V4 | 0.20 | |

IMAGE DENSITY CORRECTION METHOD AND IMAGE FORMING APPARATUS USING THE SAME

TECHNICAL FIELD

The present invention relates to an image forming apparatus utilizing an electrophotographic process such as a copier, a printer, a facsimile machine or the like, and in particular, an image density correction method capable of obtaining a high quality image by suppressing color fluctuations with printing efficiency maintained at a high level even if large color fluctuations occur during continuous printing and an image forming apparatus using the same.

BACKGROUND ART

Calibration (density correction) plays a critically important role in adjusting color in a color-capable image forming apparatus utilizing an electrophotographic process such as a copier, a printer, a facsimile machine or the like. Thus, an improvement in its correction accuracy has been strongly demanded. However, frequent halts of the apparatus at every execution of the calibration leads to confusion in prioritizing. A reduction in printing efficiency (throughput) of the apparatus due to the calibration must be suppressed as much as possible.

As an approach to meeting such a demand, an art has been known in which as soon as detecting that the number of sheets printed and the remaining number of sheets to be printed exceeds a predetermined number of sheets during continuous printing, a detection image generating section forms three kinds of detection images by toner images with each color of cyan (C), magenta (M), yellow (Y) and black (B), for example, at a 30% density, a 50% density and a 70% density as made into a unit of CMYB, respectively, in a region on a conveying belt between a preceding sheet and a subsequent sheet after the predetermined number of sheets. The detection images are detected by a reflective photosensor. A difference in density is compared with an ideal density value, and a density correction is carried out if necessary (see Japanese Published Unexamined Patent Application No. 2006-79001). According to the art described in the foregoing patent literature, printing does not have to be interrupted during the toner density adjustment, thereby allowing printing efficiency to be improved.

However, in the prior art described in the aforementioned patent literature wherein three kinds of patch images varying in density ratio (density percentage) are formed to be compared with an ideal density value thereupon conducting a density correction when needed, developing characteristics of a printer engine cannot be corrected, and merely input/output characteristics (image processing) are changed. Therefore, there is a possibility that when relatively large color fluctuations occur during continuous printing, the fluctuations cannot be suppressed.

SUMMARY OF THE INVENTION

The present invention focuses attention on the problem of the foregoing prior art, and accordingly, an object of the present invention is to obtain a high quality image by suppressing color fluctuations with printing efficiency maintained at a high level even if large color fluctuations occur during continuous printing.

In order to achieve the aforementioned object, an image density correction method in accordance with the present invention is one in an image forming apparatus provided with an image density adjustment capability and includes a patch image forming step of forming a plurality of toner amount detection patch images on an image supporter for each variation in a plurality of preset mutually different developing biases, a patch image density obtaining step of obtaining each density of the plurality of the formed patch images, an actual toner amount calculating step of obtaining each actual toner amount based on the obtained each density of the plurality of the patch images, a relational characteristics storing step of storing relational characteristics in which the actual toner amount is associated with each variation in the developing biases, and a developing bias setting step of setting a developing bias for realizing a preset reference toner amount based on the relational characteristics stored in the relational characteristics storing step and the reference toner amount. The patch image forming step includes a step of forming a between-sheet patch image at the preset developing bias in a region on the image supporter between a plurality of sheets of paper during continuous printing. The patch image density obtaining step includes a step of obtaining a density of the formed between-sheet patch image. The actual toner amount calculating step includes a step of obtaining an actual toner amount based on the obtained density of the between-sheet patch image. The developing bias setting step includes a step of conducting an image density correction by determining whether the obtained actual toner amount and the reference toner amount are in agreement, reconstructing the relational characteristics stored in the relational characteristics storing step in view of both amounts to be made in agreement, when both amounts are determined as in disagreement, as a result of the determination, and resetting the developing bias for realizing the reference toner amount based on the reconstructed relational characteristics and the reference toner amount.

An image forming apparatus in accordance with the present invention is one provided with an image density adjustment capability and includes a patch image forming section forming a plurality of toner amount detection patch images on an image supporter for each variation in a plurality of preset mutually different developing biases, a patch image density obtaining section obtaining each density of the plurality of the formed patch images, an actual toner amount calculating section obtaining each actual toner amount based on the obtained each density of the plurality of the patch images, a relational characteristics storing section storing relational characteristics in which the actual toner amount is associated with each variation in the developing biases, and a developing bias setting section setting a developing bias for realizing a preset reference toner amount based on the relational characteristics and the reference toner amount. The patch image forming section forms a between-sheet patch image at the preset developing bias in a region on the image supporter between a plurality of sheets of paper during continuous printing. The patch image density obtaining section obtains a density of the formed between-sheet patch image. The actual toner amount calculating section obtains an actual toner amount based on the obtained density of the between-sheet patch image. The developing bias setting section conducts an image density correction by determining whether the obtained actual toner amount and the reference toner amount are in agreement, reconstructing the relational characteristics in view of both amounts to be made in agreement, when both amounts are determined as in disagreement, as a result of the determination, and resetting the developing bias for realizing the reference toner amount based on the reconstructed relational characteristics and the reference toner amount.

OPERATION AND EFFECTS OF THE INVENTION

In the image density correction method in accordance with the present invention, an image density correction is carried out by forming a between-sheet patch image at a preset developing bias in a region on the image supporter between a plurality of sheets of paper during continuous printing, obtaining a density of the formed between-sheet patch image, obtaining an actual toner amount based on the obtained density of the between-sheet patch image, determining whether the obtained actual toner amount is in agreement with the reference toner amount, reconstructing relational characteristics in which the actual toner amount is associated with each variation in developing biases, by considering that both amounts are to be made in agreement, when both amounts are determined as in disagreement, as a result of the determination, and resetting the developing bias for realizing the reference toner amount based on the reconstructed relational characteristics and the reference toner amount. More specifically, when the actual toner amount having been obtained through obtaining a density of the between-sheet patch image having been formed during continuous printing is determined as in disagreement with the reference toner amount, the relational characteristics in which the actual toner amount is associated with each variation in developing biases are reconstructed by considering the actual toner amount is to be made in agreement with the reference toner amount. The developing bias for realizing the reference toner amount is reset based on the reconstructed relational characteristics and the reference toner amount. As a result, even if large color fluctuations occur during continuous printing, a high quality image can be obtained by suppressing the color fluctuations with printing efficiency maintained at a high level.

In the image forming apparatus in accordance with the present invention, the patch image forming section forms a between-sheet patch image at a preset developing bias in a region on the image supporter between a plurality of sheets of paper during continuous printing. In response to that, the patch image density obtaining section obtains a density of the formed between-sheet patch image. The actual toner amount calculating section obtains an actual toner amount based on the obtained density of the between-sheet patch image. The developing bias setting section carries out an image density correction by determining whether the obtained actual toner amount and the reference toner amount are in agreement, reconstructing the relational characteristics stored in the relational characteristics storing section in view of both amounts to be made in agreement, when both amounts are determined as in disagreement, as a result of the determination, and resetting the developing bias for realizing the reference toner amount based on the reconstructed relational characteristics and the reference toner amount. More specifically, when a determination that the actual toner amount having been obtained through obtaining a density of the between-sheet patch image having been formed during continuous printing disagrees with the reference toner amount is made, the relational characteristics in which the actual toner amount is associated with each variation in developing biases are reconstructed by considering that the actual toner amount is to be made in agreement with the reference toner amount. The developing bias for realizing the reference toner amount is reset based on the reconstructed relational characteristics and the reference toner amount. As a result, even if large color fluctuations occur during continuous printing, an image forming apparatus capable of forming a high quality image by suppressing the color fluctuations with printing efficiency maintained at a high level can be obtained.

DETAILED DESCRIPTION OF THE INVENTION

Hereinafter, an image density correction method and an image forming apparatus using the same in accordance with an embodiment of the present invention are described in detail with reference to the drawings.

[Configuration of the Image Forming Apparatus]

Figure 1:
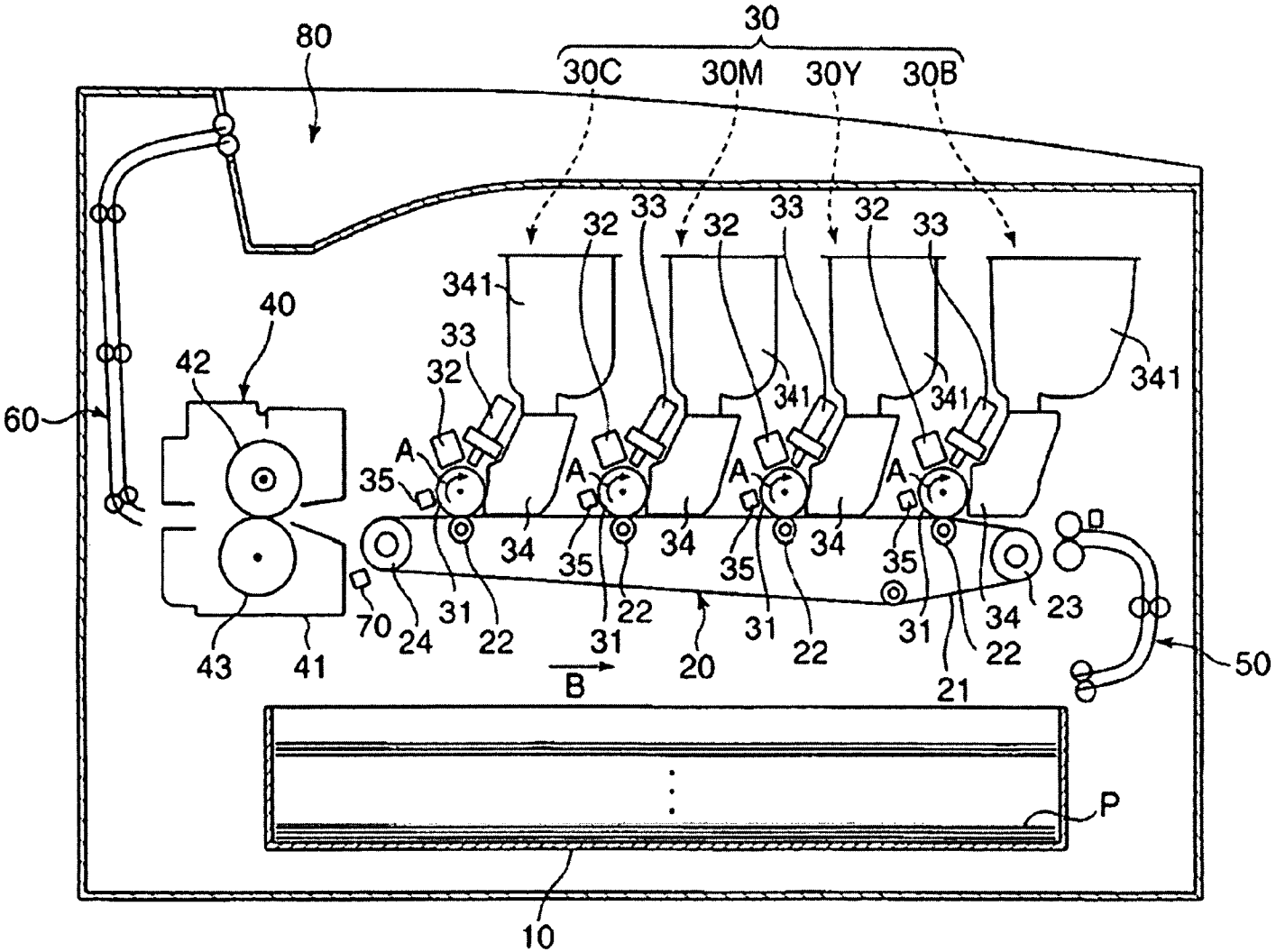
FIG. 1 is a schematic explanatory diagram showing a configuration of an image forming apparatus in accordance with an embodiment of the present invention.

As shown in FIG. 1, the image forming apparatus in accordance with the embodiment of the present invention is a so-called tandem color printer. The apparatus includes a paper feeding cassette 10, a transfer conveying section 20 arranged above the paper feeding cassette 10, an image forming section 30 arranged above the transfer conveying section 20, a fusing section 40 arranged on the left side of a paper surface relative to the transfer conveying section 20, a first conveying passage 50 leading a sheet of paper P placed in the paper feeding cassette 10 to the transfer conveying section 20 and a second conveying passage 60 leading the sheet of paper P which has been fused by the fusing section 40 to a discharging tray 80.

The paper feeding cassette 10 is stored with a sheet of paper P inside. The stored sheet of paper P is picked up by a paper feeding roller (not shown) one by one, thereafter being discharged to the first conveying passage 50.

The image forming section 30 includes image forming sections 30B, 30Y, 30M and 30C forming toner images of black (B), yellow (Y), magenta (M) and cyan (C), respectively. The image forming sections 30B to 30C have a common fundamental structure although the color of toner stored therein is different from one another. Therefore, only the image forming section 30B is described below, and explanations in connection with other image forming sections 30Y, 30M and 30C are omitted.

The image forming section 30B includes a photoconductive drum 31, a charging section 32, an exposing section 33, a developing section 34 and a cleaner section 35. The photoconductive drum 31 is a cylindrical member and rotates in a clockwise direction (direction A shown) as supplied with driving force by a motor (not shown). The exposing section 33 includes a light source such as a light-emitting diode or a laser diode. The exposing section 33 irradiates the photoconductive drum 31 having been charged by the charging section 32 with an optical signal having been modulated based on image data, thereupon forming an electrostatic latent image related to the image data. The developing section 34 includes a toner box 341 storing toner of black (B). The developing section 34 supplies the Black toner to the photoconductive drum 31 on which the electrostatic latent image has been formed, thereupon forming a Black toner image. The Black toner image having been formed on the photoconductive drum 31 is transferred on the paper P or an intermediate transfer belt 21 by a transfer roller 22. The cleaner section 35 removes toner adhered to the surface of the photoconductive drum 31 on which the Black toner image has been transferred.

The transfer conveying section 20 includes the intermediate transfer belt 21, the transfer roller 22, a right roller 23 and a left roller 24. The right roller 23 is arranged beneath the image forming section 30B. The left roller 24 is arranged beneath the image forming section 30C. The intermediate transfer belt 21 is a strip-shaped endless belt, stretched between the right roller 23 and the left roller 24. The intermediate transfer belt 21 is rotated at a constant speed in a counterclockwise direction (direction B) by the right and left rollers 23, 24. The intermediate transfer belt 21 is composed of a resin material with heat resistance such as polyimide resin. Four transfer rollers 22 are arranged on the inner periphery side of the intermediate transfer belt 21 and in the opposed positions to four photoconductive drums 31, respectively. The transfer roller 22 is composed of a rubber material with electrical conductivity. Each transfer roller 22 has a function of transferring a toner image with each color having been formed on each photoconductive drum 31, on the paper P or intermediate transfer belt 21. On the outer periphery side of the intermediate transfer belt 21 and in the vicinity of the left roller 24, a density sensor 70 is arranged in a position corresponding to roughly center in a width direction of the intermediate transfer belt 21 (a perpendicular direction relative to the paper surface). The density sensor 70 constitutes a part of a patch image density obtaining section of the present invention and is composed of a reflective photosensor, for example. The density sensor 70 has a function of detecting and obtaining a density of the toner image having been formed on the intermediate transfer belt 21.

The fusing section 40 includes a thermal shield box 41, a fusing roller 42 housing a heater and a pressure roller 43. The fusing section 40 fuses the toner image on the paper P by hot-conveying the paper P on which the toner image has been formed.

[Functional Block Diagram Showing an Electrical Configuration of the Image Forming Apparatus]

Figure 2:
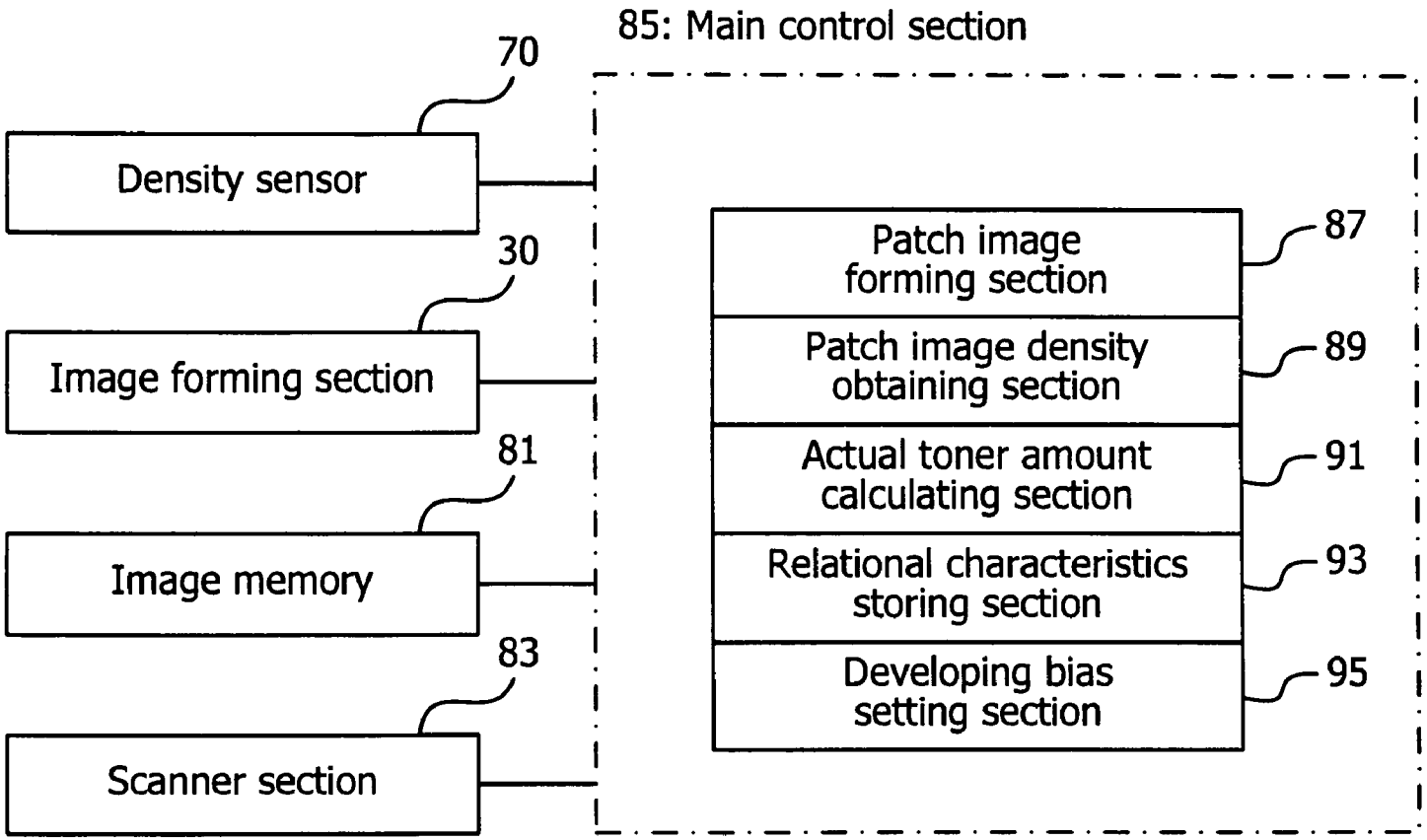
FIG. 2 is a functional block diagram centering on a main control section of the image forming apparatus in accordance with the embodiment of the present invention.

As shown in FIG. 2, the density sensor 70, the image forming section 30, an image memory 81 and a scanner section 83 are connected to the main control section 85. The scanner section 83 reads an image on a document with use of a photoelectric converter device such as a charge-coupled device (CCD), and then forwards the obtained document image data to the main control section 85. The image memory 81 stores the document image data having been read by the scanner section 83. The image forming section 30 reads out the image data having been stored on the image memory 81 and then prints it out on the paper P.

In order to achieve the object of obtaining a high quality image by suppressing color fluctuations with printing efficiency maintained at a high level even if large color fluctuations occur during continuous printing, the main control section 85 taking charge of control of the image forming apparatus includes a patch image forming section 87, a patch image density obtaining section 89, an actual toner amount calculating section 91, a relational characteristics storing section 93 and a developing bias setting section 95.

The patch image forming section 87 has a function of forming a plurality of toner amount detection patch images on the intermediate transfer belt 21 for each variation in a plurality of preset mutually different developing biases, respectively. The patch image forming section 87 also has a function of forming a between-sheet patch image at the preset developing bias in a region on the intermediate transfer belt 21 between a plurality of sheets of paper during continuous printing. Practically, the image forming section 30 receives a patch image forming command from the patch image forming section 87 to form a patch image on the intermediate transfer belt 21.

The patch image density obtaining section 89 has a function of obtaining each density of the plurality of toner amount detection patch images and the between-sheet patch image upon receiving a density detection signal from the density sensor 70.

The actual toner amount calculating section 91 has a function of obtaining an actual toner amount based on the obtained density of the plurality of toner amount detection patch images or the between-sheet patch image.

The relational characteristics storing section 93 has a function of storing relational characteristics in which the actual toner amount is associated with each variation in the developing biases. When a determination that the actual toner amount having been obtained through obtaining the density of the between-sheet patch image having been formed during continuous printing disagrees with a reference toner amount is made, the relational characteristics stored in the relational characteristics storing section 93 are updated into relational characteristics reconstructed in view of the actual toner amount and the reference toner amount to be made in agreement.

The developing bias setting section 95 has a function of setting a developing bias for realizing the reference toner amount, based on the relational characteristics stored in the relational characteristics storing section 93 and the preset reference toner amount. The developing bias setting section 95 also has a function of reconstructing the relational characteristics stored in the relational characteristics storing section 93, by considering that the actual toner amount having been obtained through obtaining the density of the between-sheet patch image having been formed during continuous printing is to be made in agreement with the reference toner amount, when a determination that both amounts disagree is made, and then resetting the developing bias for realizing the reference toner amount, based on the reconstructed relational characteristics and the reference toner amount.

[Operation of the Image Forming Apparatus]

Next, operation of the image forming apparatus in accordance with the embodiment of the present invention is described with reference to FIGS. 3 to 9.

Figure 3:
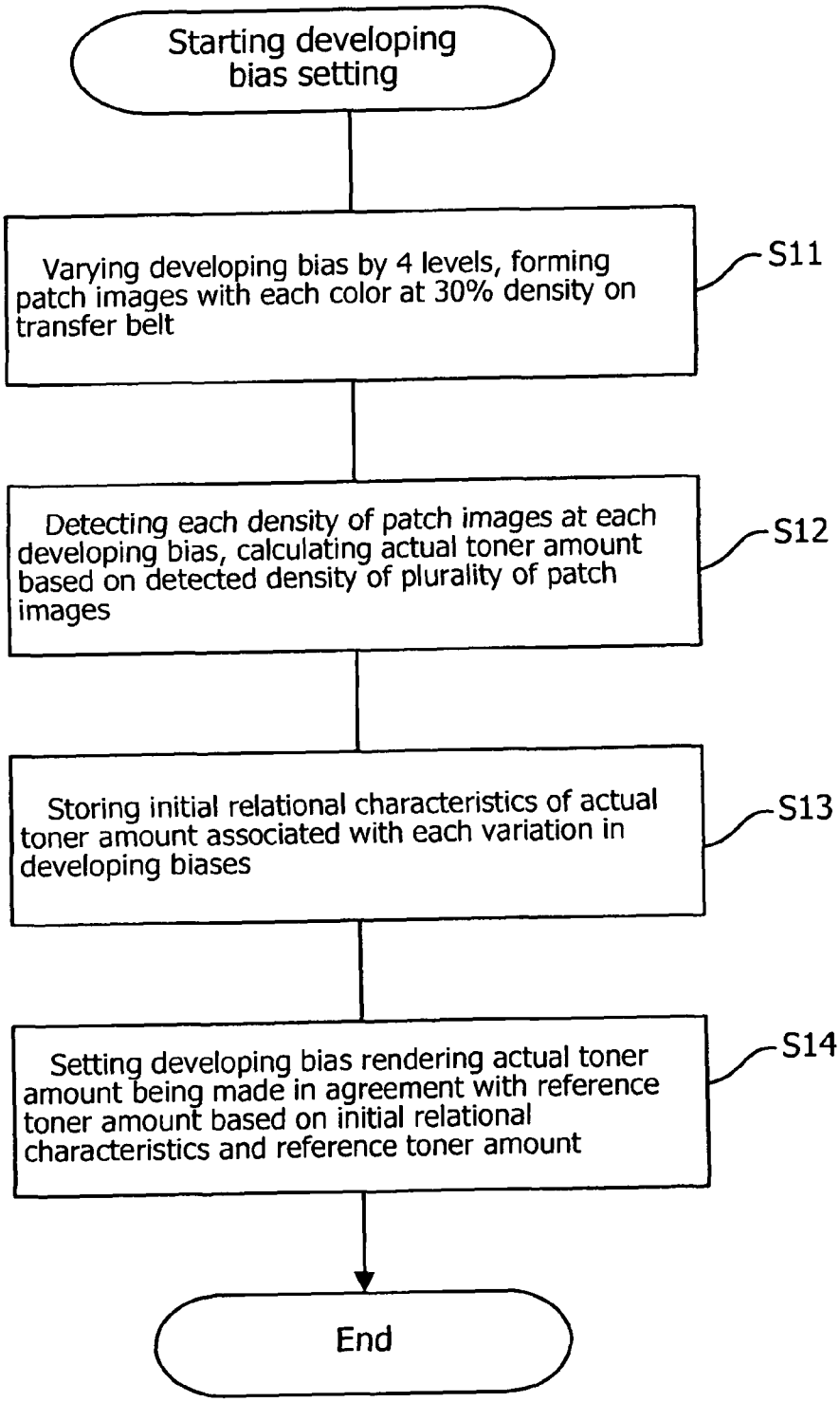
FIG. 3 is an operational flow chart in connection with a developing bias setting in the image forming apparatus in accordance with the embodiment of the present invention.

Developing bias setting operation shown in FIG. 3 is executed at an appropriate time, for example, when the image forming apparatus is turned on or in sleep mode or every time 500 sheets are printed.

Figures 5, 6:
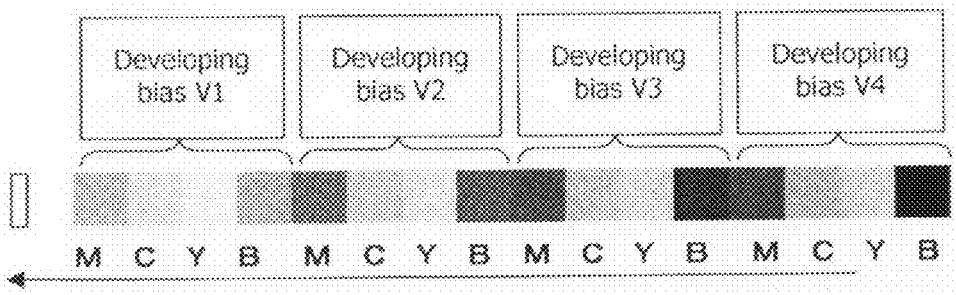
FIG. 5 is a diagram showing an example of toner amount detection patch images formed for each variation in a plurality of mutually different developing biases at the time of the developing bias setting.
FIG. 6 is a diagram showing initial relational characteristics of actual toner amounts corresponding to variations in developing biases in magenta (M).

In Step S11, the patch image forming section 87 varies the developing bias by 4 levels (V1 to V4), thereafter forming toner amount detection patch images with each color of MCYB at a halftone density from 10% to 70%, for example, and preferably at a 30% density on the intermediate transfer belt 21 (see FIG. 5).

In Step S12, the patch image density obtaining section 89 detects and obtains each density of the patch images at each developing bias. In response to that, the actual toner amount calculating section 91 obtains an actual toner amount based on the obtained each density of the plurality of patch images by a known method such as a look-up table method. The actual toner amount calculating processing in Step S12 is executed for each color of MCYB. The actual toner amount calculating processing and its subsequent processing for each color of MCYB are in common among the colors. Accordingly, only magenta (M) is described, and explanations of other colors are omitted.

In Step S13, the main control section 85 obtains initial relational characteristics of the actual toner amount that has been obtained in Step S12 and corresponds to the variation in developing biases. The main control section 85 also stores the initial relational characteristics at a predetermined address in the relational characteristics storing section 93.

In Step S14, the developing bias setting section 95 reads out the initial relational characteristics stored in the relational characteristics storing section 93. The developing bias setting section 95 also sets a developing bias which makes the actual toner amount agree with the reference toner amount, based on the initial relational characteristics and the reference toner amount.

Figure 7:
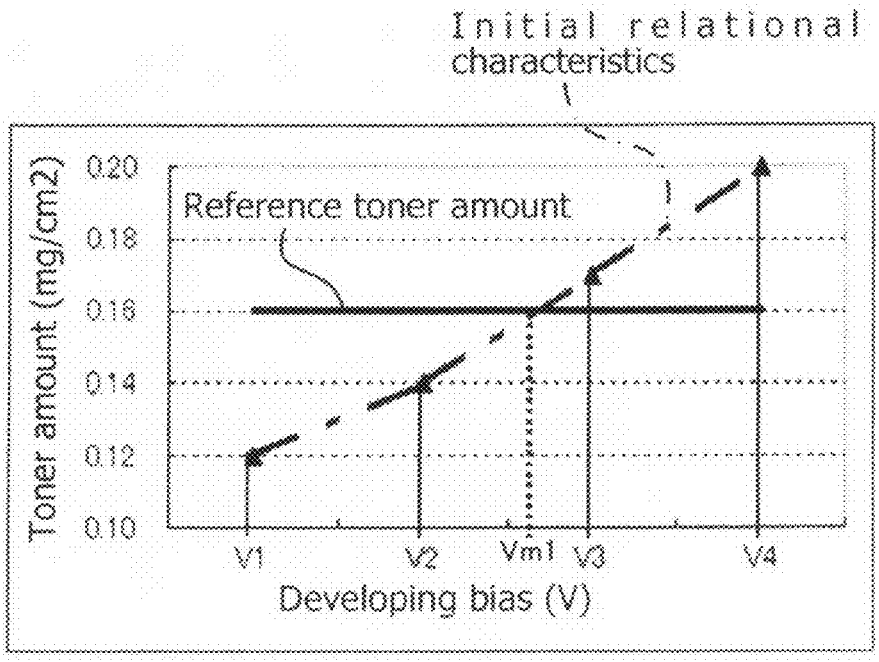
FIG. 7 is another diagram showing the initial relational characteristics of the actual toner amounts corresponding to the variations in developing biases in magenta (M).

Now, a developing bias setting for magenta (M) is described with reference to the drawings. Initial relational characteristics as shown FIGS. 6 and 7 are obtained by the actual toner amount calculating processing in Step S12. In an example of FIG. 6, the actual toner amount is 0.12 mg/cm$^2$ when the developing bias is V1. The actual toner amount is 0.14 mg/cm$^2$ when the developing bias is V2. The actual toner amount is 0.17 mg/cm$^2$ when the developing bias is V3. The actual toner amount is 0.20 mg/cm$^2$ when the developing bias is V4. A reference toner amount at a 30% density shall be 0.16 mg/cm$^2$, common in each color. In this case, as shown in FIG. 7, a developing bias (Vm1) is set based on the initial relational characteristics and the reference toner amount, at an intersection point of both as a developing bias in view of the actual toner amount to be made in agreement with the reference toner amount.

Figure 4:
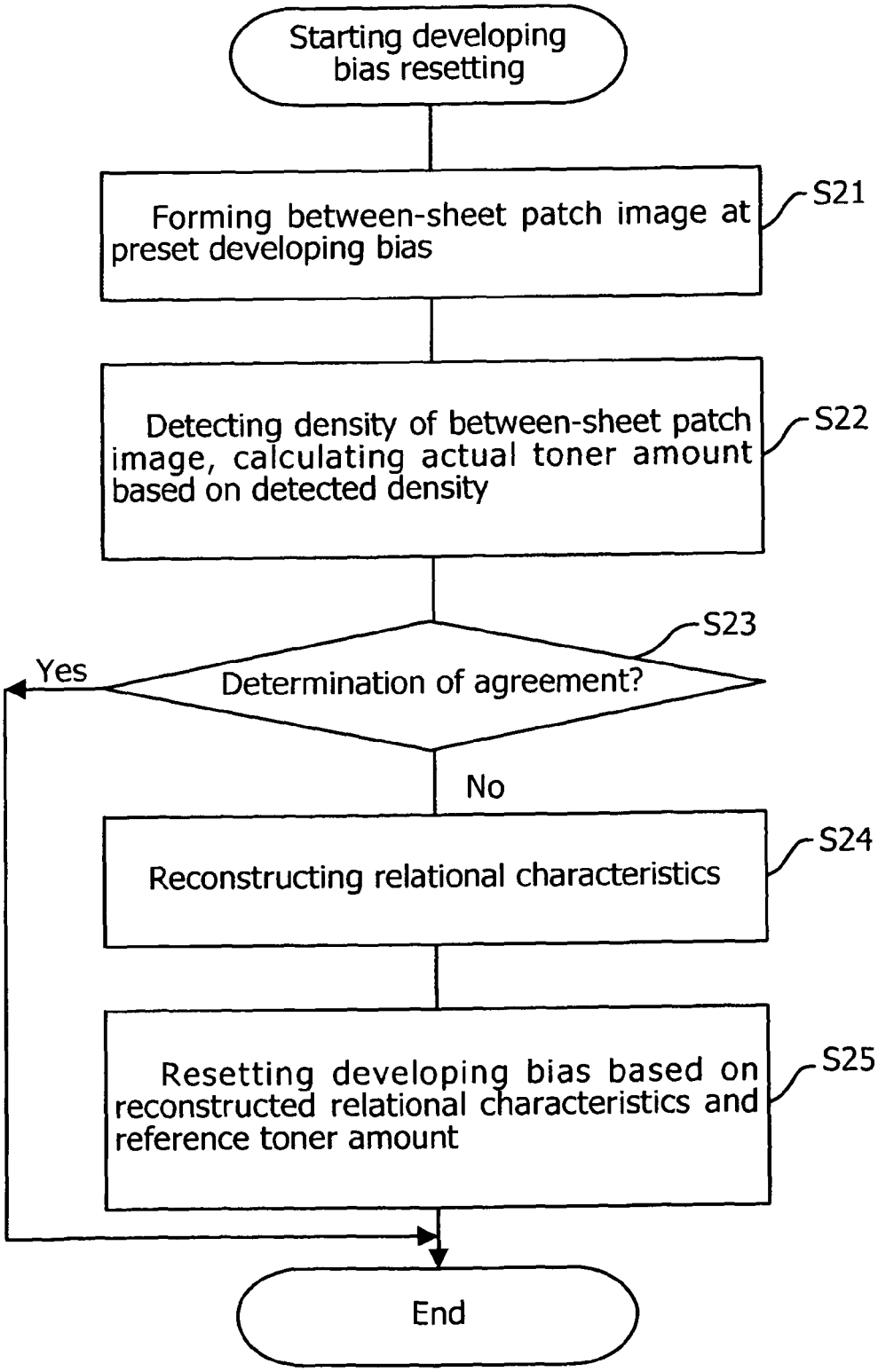
FIG. 4 is an operational flow chart in connection with a developing bias resetting in the image forming apparatus in accordance with the embodiment of the present invention.

Subsequently, developing bias resetting operation shown in FIG. 4 is carried out at an appropriate time, for example, every time a print job for 50 sheets is executed.

Figure 8:
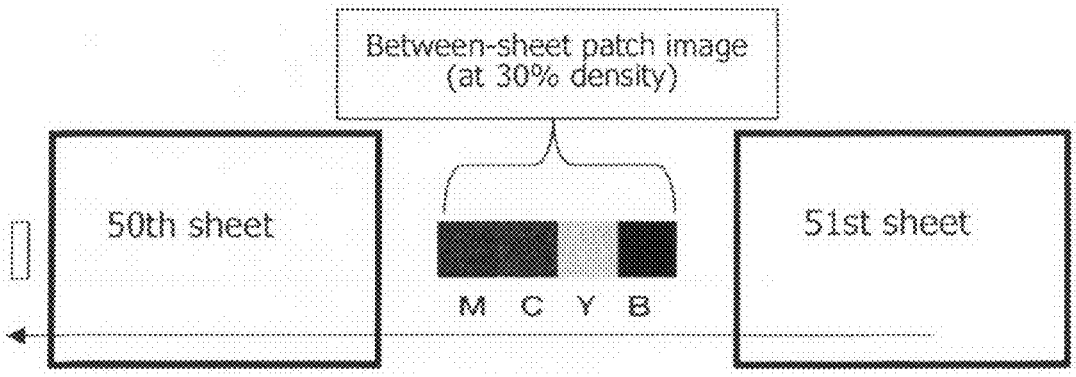
FIG. 8 is a diagram showing an example of a between-sheet patch image that is formed in a region between virtual sheets of paper at the time of the developing bias resetting.

In Step S21, the patch image forming section 87 forms a between-sheet patch image with each color of MCYB at a halftone density from 10% to 70%, for example, and preferably at a 30% density at the developing bias (Vm1) having been set in Step S14, in a region on the intermediate transfer belt 21 between a plurality of virtual sheets of paper during continuous printing (see FIG. 8).

In Step S22, the patch image density obtaining section 89 detects and obtains a density of the between-sheet patch image. In response to that, the actual toner amount calculating section 91 obtains an actual toner amount based on the obtained density of the between-sheet patch image by a known method such as a look-up table method. The actual toner amount calculating processing in Step S22 is conducted for each color of MCYB. Since the actual toner amount calculating processing and its subsequent processing for each color of MCYB are in common among the colors, only magenta (M) is described below and explanations of other colors are omitted.

In Step S23, the main control section 85 determines whether the actual toner amount having been obtained in Step S22 agrees with the reference toner amount.

When both are determined as being in agreement, as a result of the determination in Step S23, the main control section 85 terminates the whole of the developing bias resetting processing.

On the other hand, when a determination that both disagree is made, as a result of the determination in Step S23, the developing bias setting section 95 reads out the initial relational characteristics stored in the relational characteristics storing section 93 and reconstructs the read-out initial relational characteristics by considering that the actual toner amount having been obtained in Step S22 and the reference toner amount are to be made in agreement (Step S24).

In Step S25, the developing bias setting section 95 resets the developing bias for realizing the reference toner amount, based on the relational characteristics having been reconstructed in Step S24 and the reference toner amount, thereafter terminating the whole processing. In a print job to be executed after Step S25, image forming operation is carried out by applying the developing bias value having been reset in Step S25. Consequently, an appropriate image density correction is performed during continuous printing. As a result, even if large color fluctuations occur during continuous printing, it becomes possible to obtain a high quality image by suppressing the color fluctuations with printing efficiency maintained at a high level.

Figure 9:
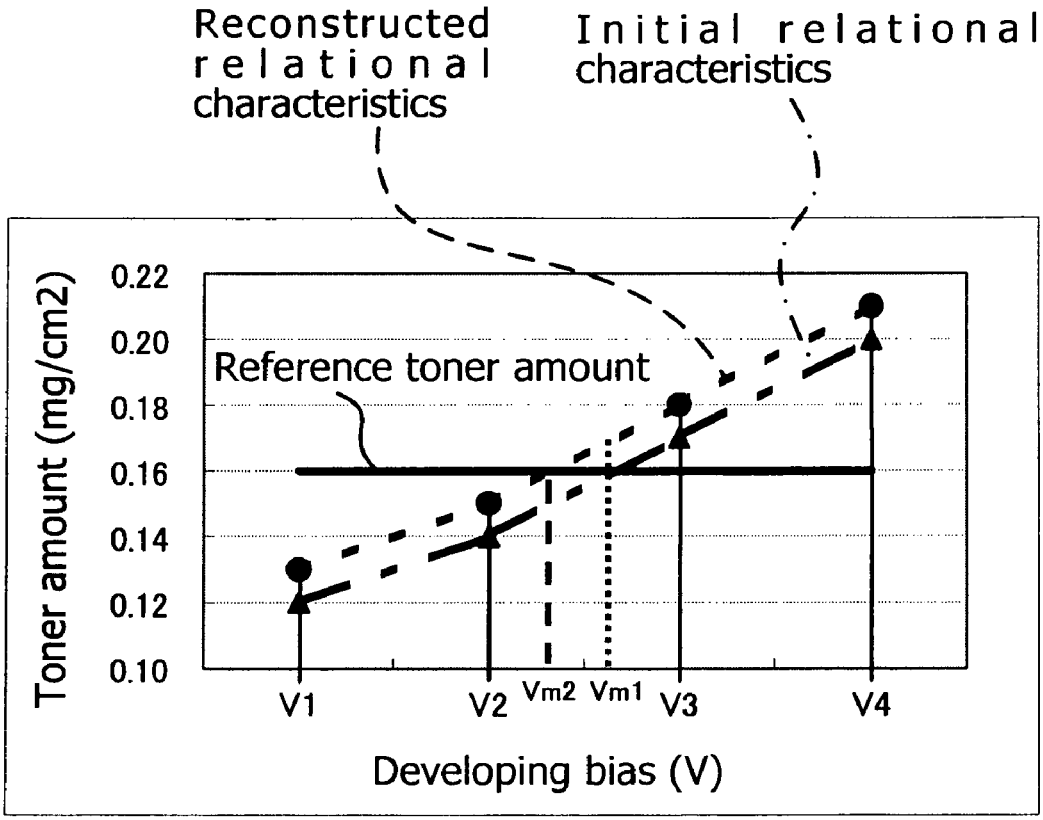
FIG. 9 is a diagram provided for an explanation given when the relational characteristics of the actual toner amounts corresponding to the variations in developing biases are reconstructed in magenta (M).

Now, a developing bias resetting for magenta (M) is described with reference to the drawings, by giving a specific example. Given that the actual toner amount obtained in Step S22 is 0.17 mg/cm$^2$, the reference toner amount is 0.16 mg/cm$^2$ and their difference is 0.01 mg/cm$^2$, relational characteristics as shown in FIG. 9, for example, are obtained by reconstructing the initial relational characteristics in Step S24. More specifically, the actual toner amount at the developing bias of Vm1 is changed from the initial amount of 0.16 mg/cm$^2$ to 0.17 mg/cm$^2$, as shown in FIG. 9. If the initial relational characteristics are maintained as they are, the actual toner amount and the reference toner amount cannot be made to agree. It has been known through a variety of experiments that a characteristic related to inclination among the initial relational characteristics having been obtained by the developing bias setting operation shown in FIG. 3 does not affect ultimate image quality even if maintained as it is. Therefore, while the characteristic related to inclination among the initial relational characteristics is maintained as it is, the initial relational characteristics are shifted, in an intercept direction, by 0.01 mg/cm$^2$ that is the difference between the actual toner amount and the reference toner amount, thereby reconstructing the initial relational characteristics (see FIG. 9). Accordingly, a developing bias (Vm2) related to an intersection point of the reconstructed relational characteristics and the reference toner amount is set based on both as a developing bias in view of the actual toner amount to be made in agreement with the reference toner amount.

Effects of the Embodiment

According to the image density correction method in accordance with the embodiment of the present invention, as described in detail above, the actual toner amount is obtained through obtaining a density of the between-sheet patch image having been formed during continuous printing. When a determination that the obtained actual toner amount disagrees with the reference toner amount is made, the initial relational characteristics in which the actual toner amount is associated with each variation in developing biases are reconstructed in view of the actual toner amount and the reference toner amount to be made in agreement. Based on the reconstructed relational characteristics and the reference toner amount, the developing bias for realizing the reference toner amount is reset. As a result, even if large color fluctuations occur during continuous printing, a high quality image can be obtained by suppressing the color fluctuations with printing efficiency maintained at a high level.

According to the image forming apparatus in accordance with the embodiment of the present invention, the developing bias for realizing the reference toner amount is reset based on the relational characteristics having been reconstructed by the foregoing image density correction method and the reference toner amount. As a result, even if large color fluctuations occur during continuous printing, an image forming apparatus capable of forming a high quality image by suppressing the color fluctuations with printing efficiency maintained at a high level can be obtained.

[Disclosure of Variations]

The present invention is not limited to the aforementioned embodiment and can be modified as appropriate without departing from the gist or technical idea of the invention understood from the claims and the entire specification. Image density correction methods and image forming apparatuses with such modifications fall within the technical scope of the present invention.

More specifically, for example, an example of varying the developing bias by 4 levels (V1 to V4) when forming toner amount detection patch images is given in the embodiment of the present invention. However, the present invention is not limited to the embodiment. A plurality of developing biases may be selectively used as appropriate, by considering that the initial relational characteristics can be constructed, when toner amount detection patch images are formed.

Further, an example of forming a patch image at a 30% density when forming a toner amount detection patch image or between-sheet patch image is given in the embodiment of the present invention. However, the present invention is not limited to the embodiment, and a density may be selected appropriately among a halftone density from 10% to 70% when forming a toner amount detection patch image or between-sheet patch image.

Furthermore, an example that the present invention is applied to a tandem color printer is given in the embodiment of the present invention. However, the present invention is not limited to the embodiment and can be applied to a 1-drum or 4-cycle color image forming apparatus and a monochrome image forming apparatus, too.

In addition, a detecting position of the patch image may be in any of the intermediate transfer body (belt or roller) or the photoconductive drum.

Lastly, there are a variety of modes obviously within the scope of identity in the present invention as described above. Such modes are not construed as departing from the intention and scope of the invention. Changes and modifications which are obvious to those skilled in the art fall within the technical scope of the claims in accordance with the present invention.

What is claimed is:

1. An image density correction method in an image forming apparatus provided with an image density adjustment capability, comprising:

a patch image forming step of forming a plurality of toner amount detection patch images on an image supporter for each variation in a plurality of preset mutually different developing biases;

a patch image density obtaining step of obtaining each density of the plurality of the formed patch images;

an actual toner amount calculating step of obtaining each actual toner amount based on the obtained each density of the plurality of the patch images;

a relational characteristics storing step of storing relational characteristics in which the actual toner amount is associated with each variation in the developing biases; and a developing bias setting step of setting a developing bias for realizing a preset reference toner amount based on the relational characteristics stored at the relational characteristics storing step and the reference toner amount, wherein the patch image forming step comprises a step of forming a between-sheet patch image at the set developing bias in a region on the image supporter between a plurality of sheets of paper during continuous printing, the patch image density obtaining step comprises a step of obtaining a density of the formed between-sheet patch image, the actual toner amount calculating step comprises a step of obtaining an actual toner amount based on the obtained density of the between-sheet patch image, and the developing bias setting step comprises a step of conducting an image density correction by determining whether the obtained actual toner amount is in agreement with the reference toner amount, reconstructing the relational characteristics stored at the relational characteristics storing step, by considering that both amounts to be made in agreement, when both amounts are determined as in disagreement, as a result of the determination, and resetting the developing bias for realizing the reference toner amount, based on the reconstructed relational characteristics and the reference toner amount.

2. The image density correction method according to claim 1, wherein the relational characteristics are reconstructed by being shifted in an intercept direction, based on a difference between the obtained actual toner amount and the reference toner amount, in view of both amounts to be made in agreement.

3. The image density correction method according to claim 1, wherein the toner amount detection patch images are formed at predetermined intervals during a print job.

4. The image density correction method according to claim 1, wherein the toner amount detection patch images or the between-sheet patch image are formed at a halftone density from 10% to 70%.

5. An image forming apparatus provided with an image density adjustment capability, comprising:

a patch image forming section forming a plurality of toner amount detection patch images on an image supporter for each variation in a plurality of preset mutually different developing biases;

a patch image density obtaining section obtaining each density of the plurality of the formed patch images;

an actual toner amount calculating section obtaining each actual toner amount based on the obtained each density of the plurality of the patch images;

a relational characteristics storing section storing relational characteristics in which the actual toner amount is associated with the each variation in the developing biases; and a developing bias setting section setting a developing bias for realizing a preset reference toner amount based on the relational characteristics stored in the relational characteristics storing section and the reference toner amount, wherein the patch image forming section forms a between-sheet patch image at the set developing bias in a region on the image supporter between a plurality of sheets of paper during continuous printing, the patch image density obtaining section obtains a density of the formed between-sheet patch image, the actual toner amount calculating section obtains an actual toner amount based on the obtained density of the between-sheet patch image, the developing bias setting section conducts an image density correction by determining whether the obtained actual toner amount agrees with the reference toner amount, reconstructing the relational characteristics stored in the relational characteristics storing section, by considering that both amounts are to be made in agreement, when both amounts are determined as in disagreement, as a result of the determination, and resetting the developing bias for realizing the reference toner amount based on the reconstructed relational characteristics and the reference toner amount.

6. The image forming apparatus according to claim 5, wherein the relational characteristics are reconstructed by being shifted in an intercept direction, based on a difference between the obtained actual toner amount and the reference toner amount, in view of both amounts to be made in agreement.

7. The image forming apparatus according to claim 5, wherein the toner amount detection patch images are formed at predetermined intervals during a print job.

8. The image forming apparatus according to claim 5, wherein the toner amount detection patch images or the between-sheet patch image are formed at a halftone density from 10% to 70%.

9. The image forming apparatus according to claim 5, wherein the image forming apparatus is a tandem color printer, the image supporter is an intermediate transfer belt, and the patch image density obtainment is executed relative to a patch image formed on the intermediate transfer belt.

10. The image forming apparatus according to claim 5, wherein the image forming apparatus is a color printer in a manner of forming a toner image with each color on the image supporter and transferring the formed toner image with each color on a sheet of paper, the image supporter is an intermediate transfer roller, and the patch image density obtainment is executed relative to a patch image formed on the intermediate transfer roller.

* * * * *